US008838002B2

(12) United States Patent
Takahashi

(10) Patent No.: US 8,838,002 B2
(45) Date of Patent: Sep. 16, 2014

(54) IMAGE HEATING APPARATUS

(75) Inventor: Masahiro Takahashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 131 days.

(21) Appl. No.: 13/566,328

(22) Filed: Aug. 3, 2012

(65) Prior Publication Data

US 2013/0051875 A1 Feb. 28, 2013

(30) Foreign Application Priority Data

Aug. 30, 2011 (JP) ..... 2011-187163

(51) Int. Cl.
*G03G 15/20* (2006.01)

(52) U.S. Cl.
CPC .... *G03G 15/2053* (2013.01); *G03G 2215/2019* (2013.01); *G03G 2215/00139* (2013.01); *G03G 15/2017* (2013.01)
USPC ..... 399/330

(58) Field of Classification Search
CPC ..... G03G 15/2017; G03G 15/2053; G03G 2215/00143; G03G 2215/00139; G03G 15/2064; G03G 2215/2003
USPC ..... 399/330, 331
See application file for complete search history.

(56) References Cited

U.S. PATENT DOCUMENTS

| | | | | |
|---|---|---|---|---|
| 5,778,294 | A | 7/1998 | Hiraoka et al. | |
| 7,194,233 | B2 * | 3/2007 | Wu et al. | 399/328 |
| 7,711,306 | B2 | 5/2010 | Kagawa | |
| 7,974,563 | B2 | 7/2011 | Sakai et al. | |
| 8,005,413 | B2 | 8/2011 | Sakakibara et al. | |
| 8,224,223 | B2 | 7/2012 | Sakakibara et al. | |
| 2007/0189817 | A1 | 8/2007 | Kagawa | |
| 2007/0217838 | A1 * | 9/2007 | Yamana et al. | 399/328 |
| 2008/0260425 | A1 * | 10/2008 | Hirayama et al. | 399/122 |
| 2009/0092422 | A1 * | 4/2009 | Kagawa | 399/328 |
| 2011/0091252 | A1 | 4/2011 | Sekihara et al. | |
| 2011/0217092 | A1 | 9/2011 | Sekihara et al. | |
| 2012/0051806 | A1 | 3/2012 | Takahashi | |
| 2012/0251204 | A1 | 10/2012 | Takahashi | |
| 2012/0257913 | A1 | 10/2012 | Sakakibara et al. | |

FOREIGN PATENT DOCUMENTS

| | | | |
|---|---|---|---|
| JP | 8-234597 | A | 9/1996 |
| JP | 9-90787 | A | 4/1997 |
| JP | 2000-75697 | A | 3/2000 |
| JP | 2000-75698 | A | 3/2000 |
| JP | 2000-75699 | A | 3/2000 |
| JP | 2000-75700 | A | 3/2000 |
| JP | 2007-212896 | A | 8/2007 |

* cited by examiner

*Primary Examiner* — Benjamin Schmitt
(74) *Attorney, Agent, or Firm* — Fitzpatrick, Cella, Harper & Scinto

(57) ABSTRACT

There is disclosed a fixing apparatus capable of correcting inclined movement of an external heating belt 105 which heats a fixing roller 101 from the outside, in an axial direction of support rollers 103 and 104. A rotary shaft 209 is disposed as a rotation center, and the external heating belt 105 is configured to intersect a generating line of the fixing roller 101. Moreover, the turning shaft 209 is disposed at a position which is offset on an upstream side in a rotating direction of the fixing roller 101. Furthermore, the support roller 104 is positioned on a downstream side in the rotating direction of the fixing roller 101, and both ends of the support roller 104 in the axial direction are movably held, respectively, so that a distance between the centers of the rollers can be variable with respect to the support roller 103.

38 Claims, 11 Drawing Sheets

IMAGE HEATING APPARATUS

BACKGROUND OF THE INVENTION

1. Field of the Invention

The present invention relates to an image heating apparatus which can be used in an electrographic system or electrostatic recording system of an image forming apparatus such as a printer, a copying machine, a facsimile machine or a multi-function machine having functions of these machines.

As the image heating apparatus, there is a fixing apparatus which heats and fixes a non-fixed image formed on a recording material to obtain the fixed image, a gloss increasing apparatus which heats an image fixed to a recording material to increase the gloss of the image, or the like.

2. Description of the Related Art

Heretofore, various image forming apparatuses have been known, and an e image forming apparatus of the electrographic system has generally spread. In the image forming apparatuses, a high productivity (the number of sheets to be printed per unit time) in various sheets (recording materials) such as thick papers is required.

In the image forming apparatus of the electrographic system, a fixing speed of a fixing apparatus (an image heating apparatus) is required to be increased, for enhancing the productivity especially in a thick paper having a large basis weight. However, the thick paper takes more heat from the fixing apparatus than a thin paper, as the paper is passed through the apparatus, and hence a quantity of heat required for the fixing becomes larger in the thick paper than in the thin paper. Consequently, there is known a technique of lowering the productivity (decreasing the fixing speed or decreasing the number of the sheets to be printed per unit time) to cope with the thick paper.

As a technique of coping with the thick paper without lowering the productivity, there is an external heating system in which an outer surface temperature of the fixing roller is maintained at a target temperature by abutting on the outer surface of a fixing roller (a heating rotary member). As the external heating system, there is a system where a heater uses an external heating belt (an endless belt), which is rotatably looped around two support rollers respectively having the internal heater, for the purpose of noticeably increasing an area which comes in contact with the fixing roller to enhance a temperature maintaining performance of the fixing roller (see JP-A-2007-212896). Specifically, the contact area between the external heating belt and the fixing roller (a heating area) includes an area where the two support rollers are come into pressure-contacted with the fixing roller via the external heating belt and an area therebetween.

However, it is actually difficult to precisely assemble the two support rollers in parallel with each other and maintain the parallelism thereof. In consequence, when the mutual parallelism of the two support rollers is not acquired, the external heating belt is inclined in a width direction thereof, which causes the possibility that the running stability of the external heating belt deteriorates.

To eliminate such a possibility, there is a technique of tilting the one support roller to the other support roller to control an inclination of the external heating belt. However, when the external heating belt has a function of heating the fixing roller, it is difficult to employ this technique.

This is because in this technique, one end side of the one support roller in an axial direction is displaced to the other end side thereof, but due to this displacement of the one support roller, a part of the area of the external heating belt, with which the fixing roller has to come into contact, is spaced apart from the fixing roller. In consequence, the function of the external heating belt for heating the fixing roller is impaired, and a fixing defect is occurred.

SUMMARY OF THE INVENTION

An object of the present invention is to provide an image heating apparatus capable of enhancing the running stability of an endless belt which heats a heating rotary member from the outside.

To achieve the above object, an image heating apparatus as an example of the present invention includes: a heating rotary member which heats a toner image on a recording material; a belt unit including an endless belt which comes in contact with and heats an outer surface of the heating rotary member, and a first support roller and a second support roller which rotatably support the endless belt and press the endless belt onto the heating rotary member so that the endless belt comes in contact with the heating rotary member; and a holding unit which swingably holds the belt unit in a direction in which an axis line of the first support roller intersects a generating line of the heating rotary member when the endless belt comes in contact with the heating rotary member, wherein the belt unit includes a support portion which slidably supports the second support roller so that a distance between a center of the first support roller and a center of the second support roller is variable.

An image heating apparatus as another example of the present invention includes: a heating rotary member which heats a toner image on a recording material; a belt unit including an endless belt which comes in contact with and heats an outer surface of the heating rotary member, and at least two support rollers which rotatably support the endless belt and press the endless belt onto the heating rotary member so that the endless belt comes in contact with the heating rotary member; a swing shaft which is disposed on a side opposite to the heating rotary member with respect to the endless belt and is substantially parallel to a normal line direction of a surface of the endless belt which is positioned between the support rollers; and a holding unit which holds the belt unit swingably around the swing shaft, wherein the belt unit includes a support portion which slidably supports one of the support rollers so that a distance between centers of the support rollers is variable.

The other objects of the present invention will become apparent by reading the following detailed description with reference to the accompanying drawings.

Further features of the present invention will become apparent from the following description of exemplary embodiments with reference to the attached drawings.

DESCRIPTION OF THE EMBODIMENTS

Hereinafter, embodiments according to the present invention will specifically be described. It is to be noted that the following embodiments are examples of the best exemplary embodiment in the present invention, but the present invention is not limited to constitutions of these embodiments, and each constitutions can be modified within the scope of the present invention.

Embodiment (1) Image Forming Apparatus

Figure 1:
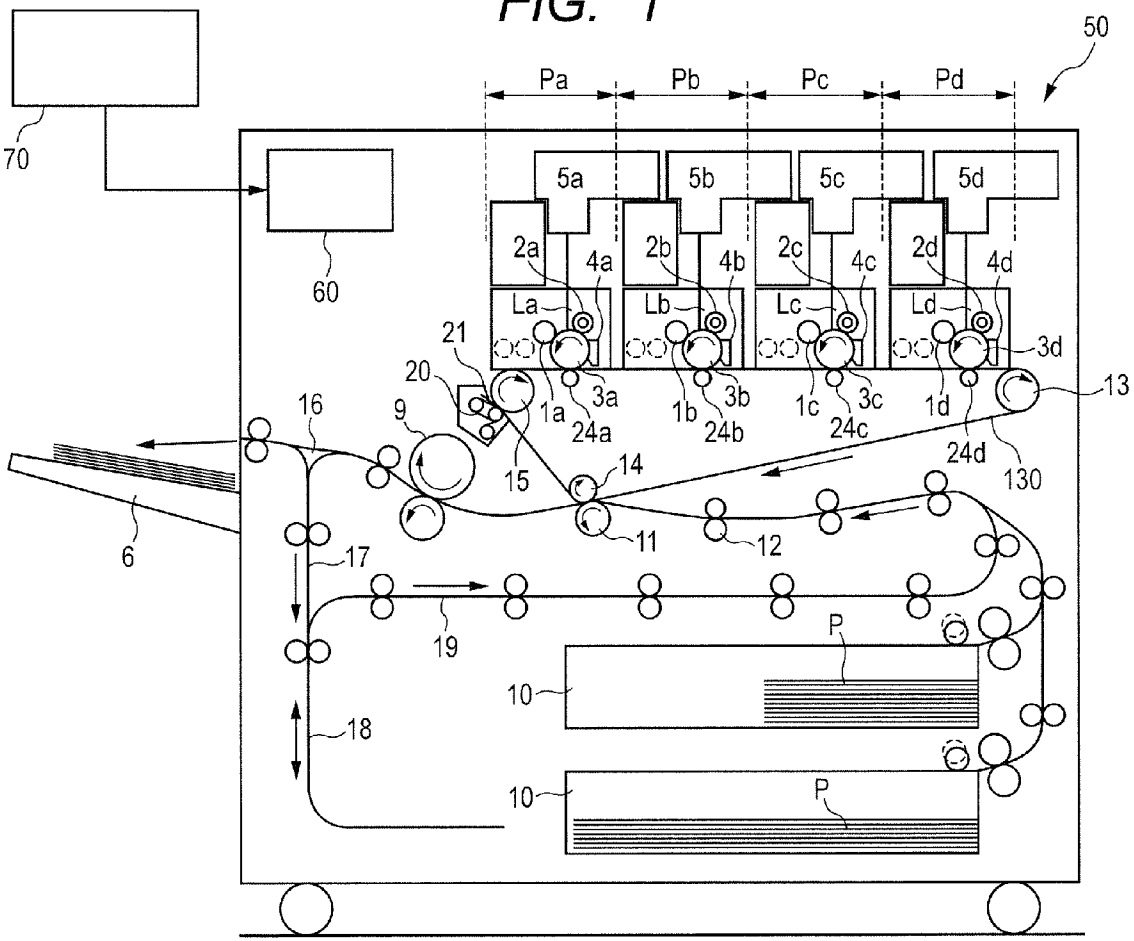
FIG. 1 is a schematic constitutional view of an image heating apparatus in an embodiment.

FIG. 1 is a schematic constitutional view showing an example of an image forming apparatus 50 including a fixing apparatus 9 which functions as an image heating apparatus according to the present invention. The apparatus 50 is an inline type electrographic color laser beam printer of an intermediate transfer system. A full-color image can be formed on a recording material P on the basis of an image signal input into a control circuit 60 from a host apparatus 70 such as a personal computer.

In the apparatus 50, first, second, third and fourth image forming sections Pa, Pb, Pc and Pd are arranged, and toner images respectively having different colors are formed in an electrographic process by parallel processing. The image forming sections Pa, Pb, Pc and Pd include exclusive image bearing members, i.e., electrographic photosensitive drums 3*a*, 3*b*, 3*c* and 3*d* to be rotated and driven in the present embodiment, respectively, and the toner images having different colors are formed on the drums 3*a*, 3*b*, 3*c* and 3*d*, respectively.

An intermediate transfer belt 130 circulating and moving as an intermediate transfer member is disposed adjacent to each of the drums 3*a*, 3*b*, 3*c* and 3*d*. The respective color toner images formed on the drums 3*a*, 3*b*, 3*c* and 3*d* are successively superimposed on one another and primarily transferred onto the belt 130. The toner image on the belt is secondarily transferred onto the recording material P by a secondary transfer roller 11. The recording material P, onto which the toner image has been transferred, has the toner image fixed thereto by heating and pressurizing in the fixing apparatus 9, and is discharged to a tray 6 out of the apparatus, as a recording image formed material.

In the outer peripheries of the drums 3*a*, 3*b*, 3*c* and 3*d*, there are arranged drum charging units 2*a*, 2*b*, 2*c* and 2*d*, developing units 1*a*, 1*b*, 1*c* and 1*d*, primary transfer charging units 24*a*, 24*b*, 24*c* and 24*d*, and cleaners 4*a*, 4*b*, 4*c* and 4*d*, respectively. In an upper part of the apparatus, laser scanners 5*a*, 5*b*, 5*c* and 5*d* are arranged.

The drums 3*a*, 3*b*, 3*c* and 3*d* are uniformly subjected to charging processing by the charging units 2*a*, 2*b*, 2*c* and 2*d*. Laser lights emitted from the laser scanners 5*a*, 5*b*, 5*c* and 5*d* are scanned by rotating a polygon mirror. A luminous flux of the scanning lights is deflected by a reflection mirror, and concentrated on generating lines of the drums 3*a*, 3*b*, 3*c* and 3*d* by fθ lenses to form exposure lights La, Lb, Lc and Ld. In consequence, latent images are formed on the drums 3*a*, 3*b*, 3*c* and 3*d* in accordance with the image signal.

In the present embodiment, the developing units 1*a*, 1*b*, 1*c* and 1*d* are filled with predetermined amounts of toners of cyan, magenta, yellow and black as developers by a not-shown supply device, respectively. The developing units 1*a*, 1*b*, 1*c* and 1*d* develop the latent images on the drums 3*a*, 3*b*, 3*c* and 3*d*, whereby the images are visible as a cyan toner image, a magenta toner image, a yellow toner image and a black toner image, respectively.

The belt 130 is rotated and driven in an arrow direction with the same peripheral speed as in the drum 3. The first-color yellow toner image formed and bore on the drum 3*a* passes through an abutment portion (a primary transfer nip portion) between the drum 3*a* and the belt 130. In this passing process, the yellow toner image is primarily transferred onto the outer peripheral surface of the belt 130 by an electric field and a pressure formed with a primary transfer bias applied from the primary transfer charging unit 24*a* to the belt 130.

Hereinafter, the second-color magenta toner image, the third-color cyan toner image and the fourth-color black toner image are similarly and successively superimposed and transferred onto the belt 130, to form a synthesized color toner image corresponding to color image information input into the apparatus 50.

The drums 3*a*, 3*b*, 3*c* and 3*d* from which the primary transfer has been completed are cleaned by the cleaners 4*a*, 4*b*, 4*c* and 4*d*, respectively, to remove transfer residual toners, thereby continuously preparing for the next latent image formation and the like. The toner and the other foreign matters remaining on the belt 130 are wiped off by making a cleaning web (non-woven cloth) 21 of a web cleaner 20 to abut on the surface of the belt 130.

The belt 130 is sandwiched between the secondary transfer roller 11 and the roller 14 among three rollers 13, 14 and 15 around which the belt 130 is looped, and the roller 11 is brought into pressure-contact with the belt 130, whereby a secondary transfer nip portion is formed between the roller 11 and the belt 130. A predetermined secondary transfer bias is applied to the roller 11 from a secondary transfer bias source.

The synthesized color toner image superimposed and transferred onto the belt 130 is transferred onto the recording material (sheet) P in the secondary transfer nip portion. That is, the recording material P is fed from a sheet feed cassette 10 to the secondary transfer nip portion through a resist roller 12 and a guide prior to the transfer, at a predetermined timing, and the material is nipped and conveyed by the nip portion. Simultaneously, the secondary transfer bias is applied to the roller 11 from the bias power source. By the secondary transfer bias, the synthesized color toner image is transferred from the belt 130 to the recording material P. The recording material P passing through the nip portion and receiving the transferred toner image is separated from the belt 130, and introduced into the fixing apparatus 9 to receive heat and a pressure, whereby a non-fixed image is fixed as the fixed image.

In a simplex copying mode, the recording material P discharged from the fixing apparatus 9 passes through a sheet path above a flapper 16, and is discharged to the discharge sheet tray 6 out of the apparatus.

When a duplex copying mode is selected, the recording material P, which has the image formed on a first surface side and is discharged from the fixing apparatus 9, is introduced into a sheet path 17 side on a recirculation conveyance mechanism side by the flapper 16. Furthermore, the recording material P enters a switchback sheet path 18, and is drawn out of the sheet path 18, conveyed and guided to a re-conveyance sheet path 19. Then, the recording material P passes through the resist roller 12 and the guide prior to the transfer along the sheet path 19, and is introduced again into the secondary transfer nip portion at a predetermined timing in a state where the front/back surface of the material is inverted.

In consequence, the toner image on the belt 130 is secondarily transferred onto a second surface side of the recording material P. The recording material P, which has the toner image secondarily transferred onto the second surface thereof in the secondary transfer nip portion, is separated from the belt 130, introduced again into the fixing apparatus 9, subjected to fixing processing of the toner image, and discharged to the discharge sheet tray 6 out of the apparatus, as a duplex copied sheet.

A mono-color mode, such as a mono chromatic mode is realized by performing an image forming operation with the image forming section of a designated color. In the other image forming sections, the drums are rotated, but the image forming operation is not performed.

(2) Fixing Apparatus

Figure 2:
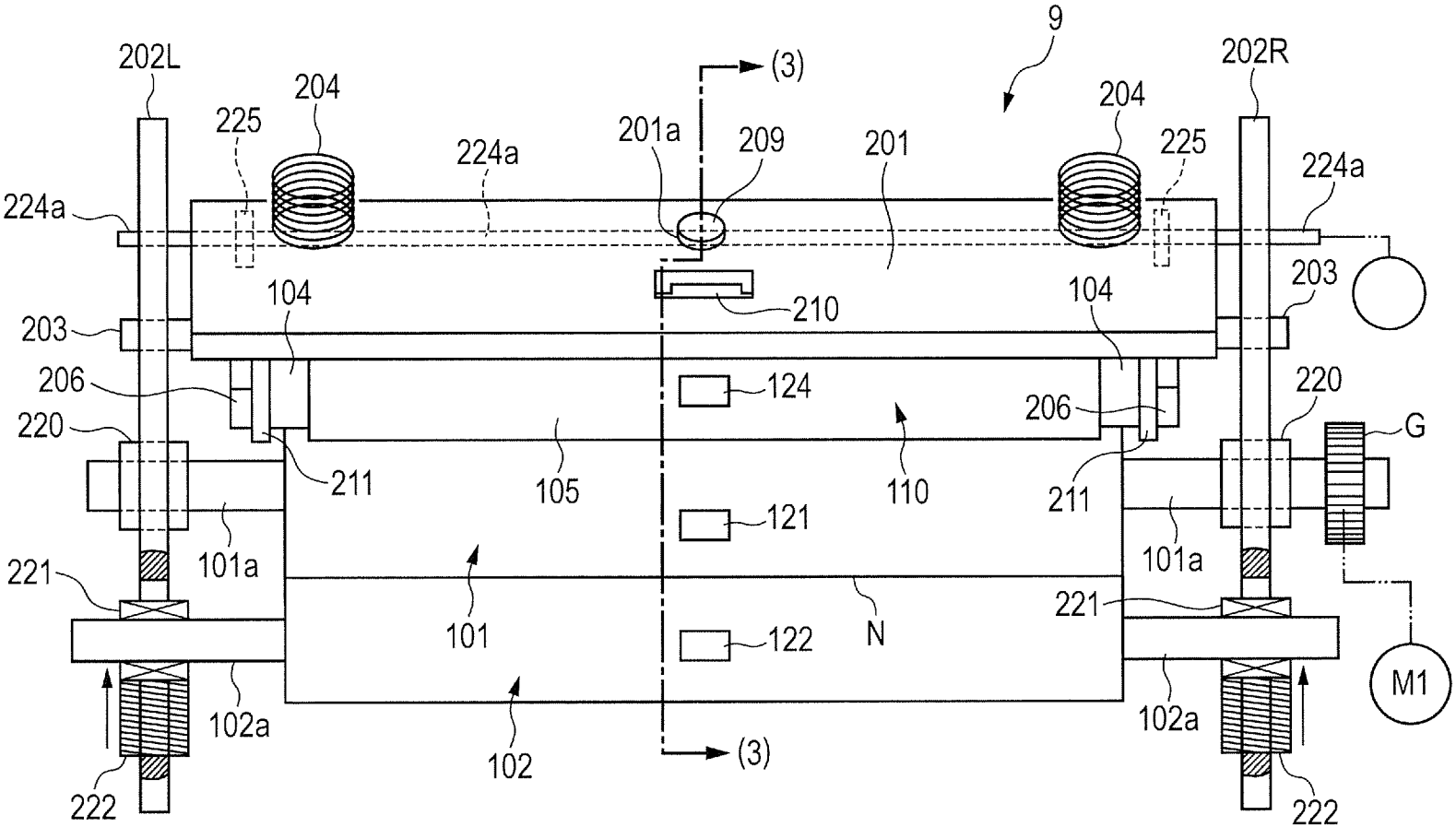
FIG. 2 is a partially cutaway schematic front view of a main part of a fixing apparatus.
Figure 3:
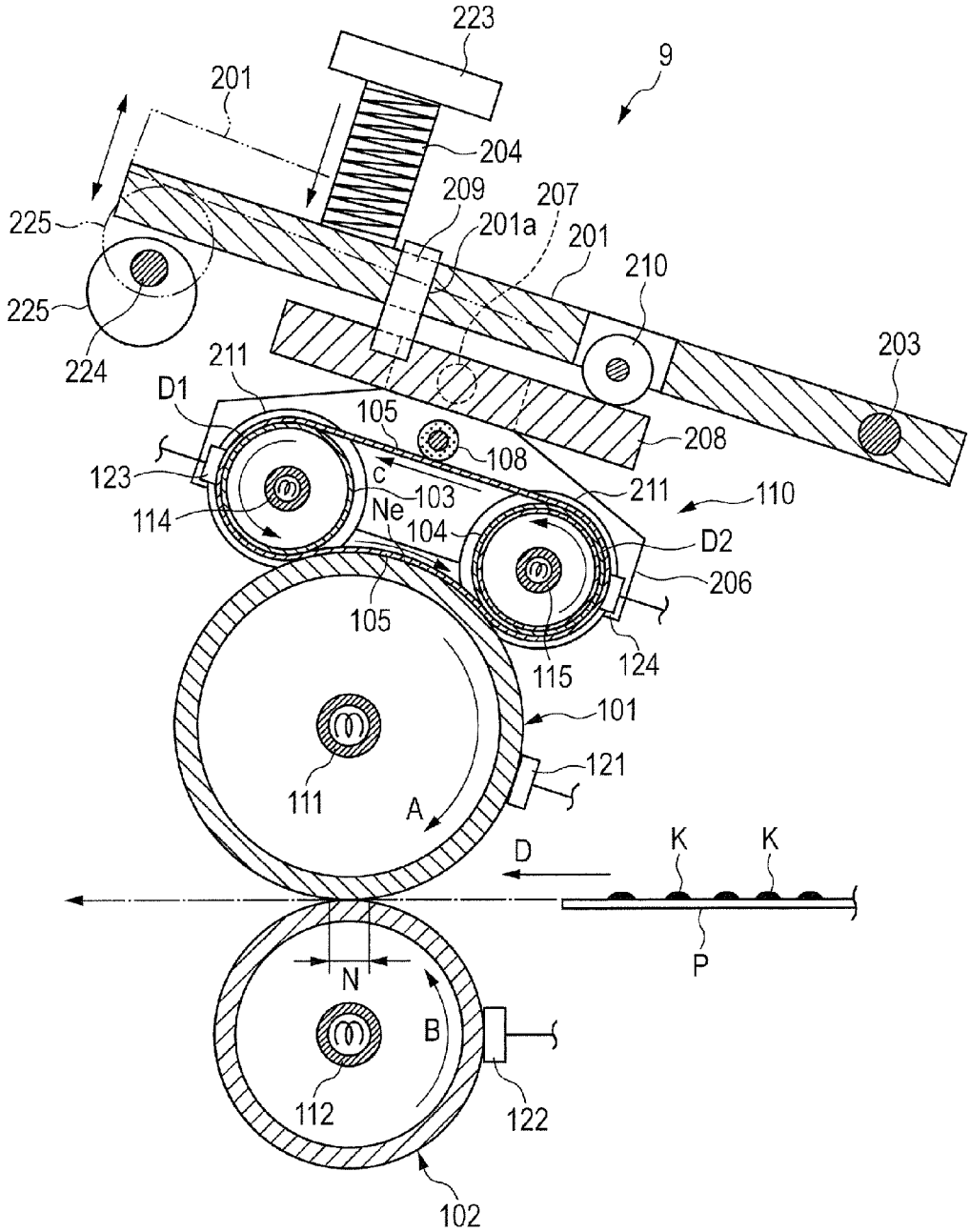
FIG. 3 is an enlarged cross-section view along the (3)-(3) line of FIG. 2.
Figure 4:
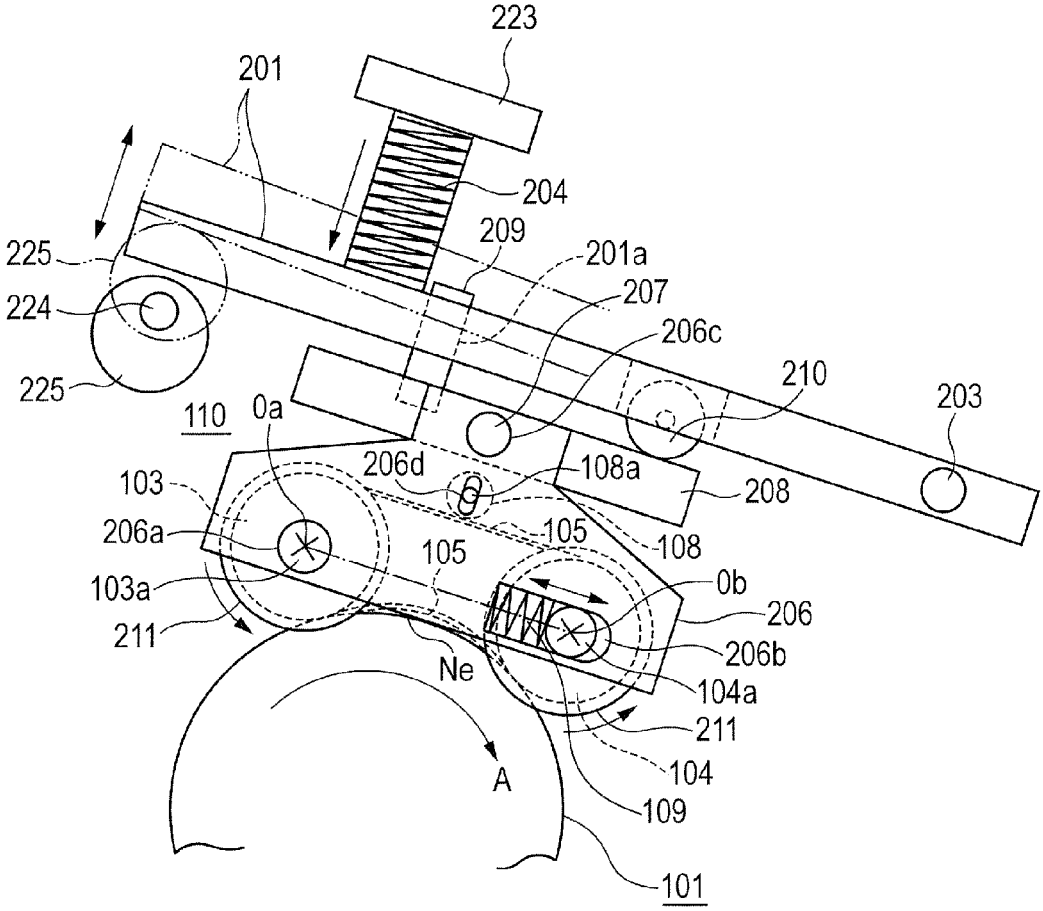
FIG. 4 is a right side view of an external heating belt assembly.
Figure 5:
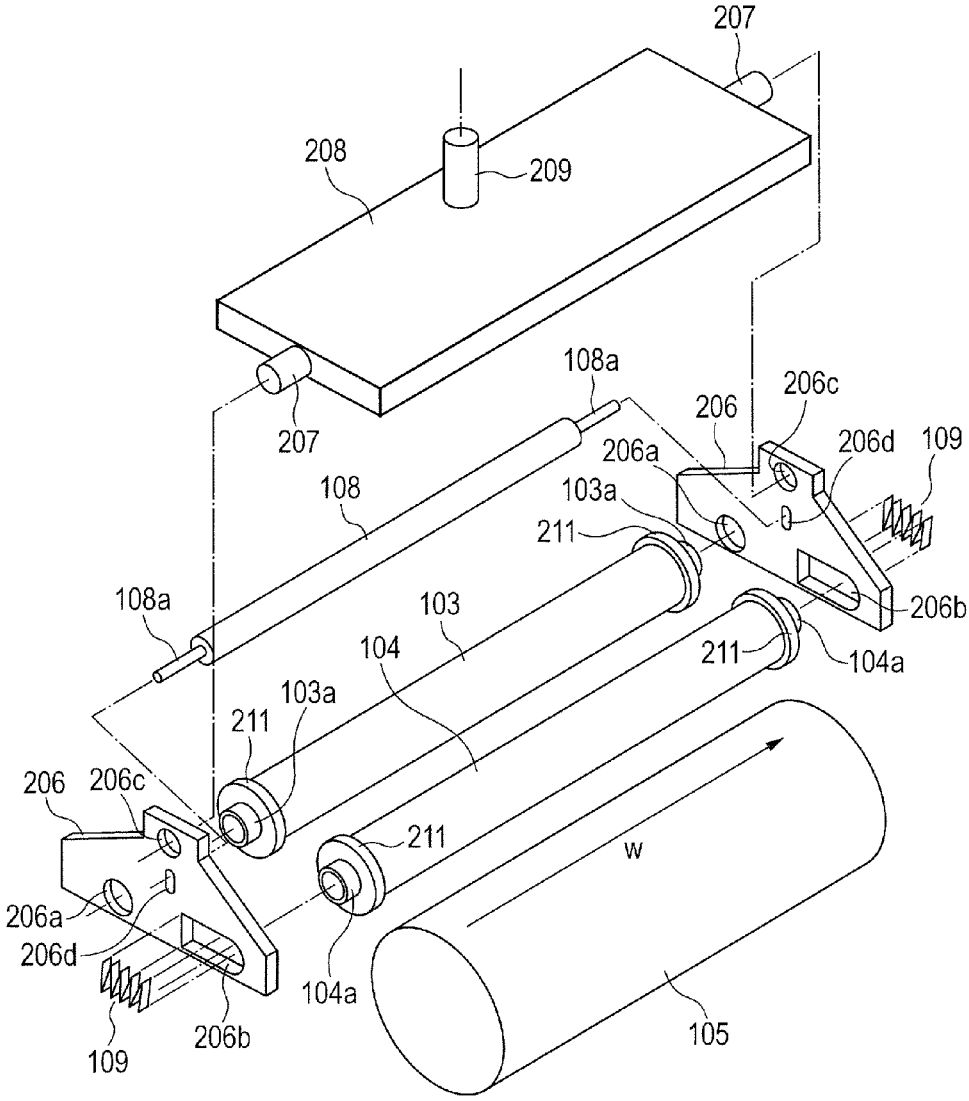
FIG. 5 is an exploded perspective view of the external heating belt assembly.
Figure 6:
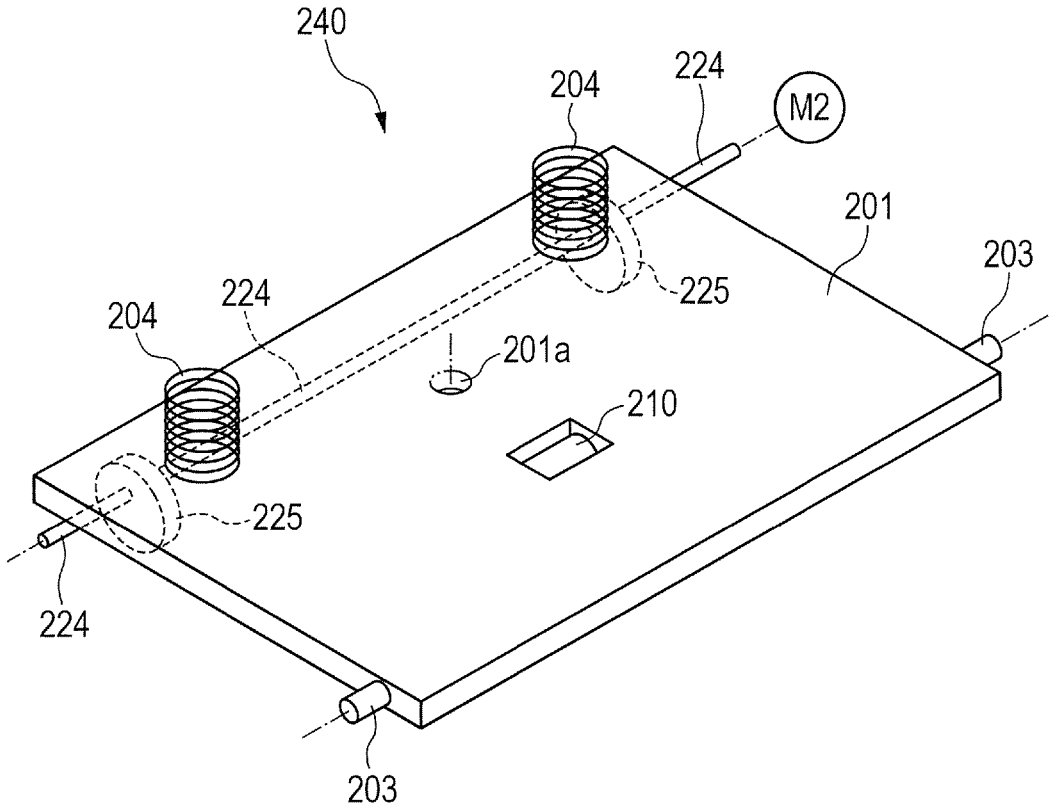
FIG. 6 is a perspective view of a pressurizing/pressurizing release mechanism of the assembly.
Figure 7:
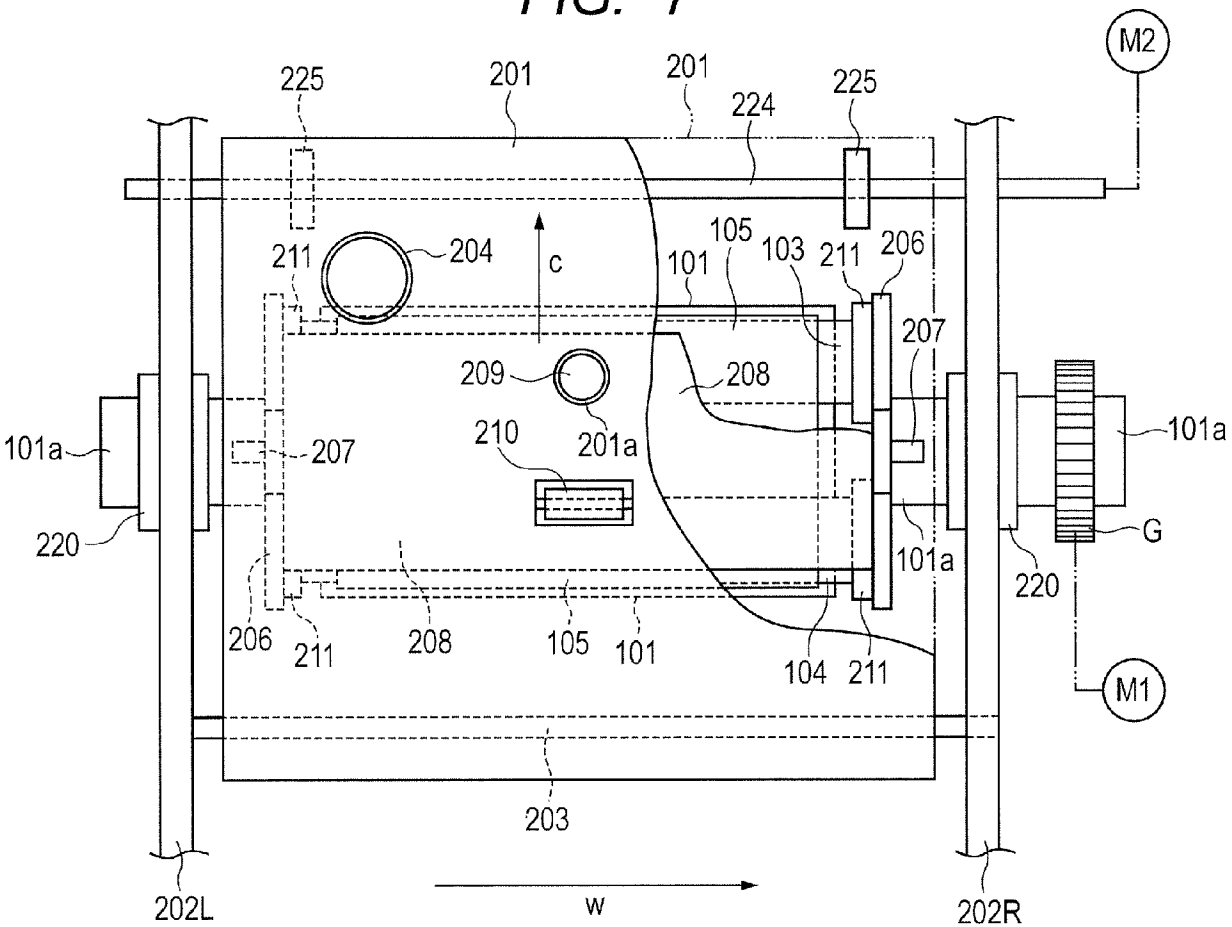
FIG. 7 is a partially cutaway schematic plan view of the assembly.
Figure 8:
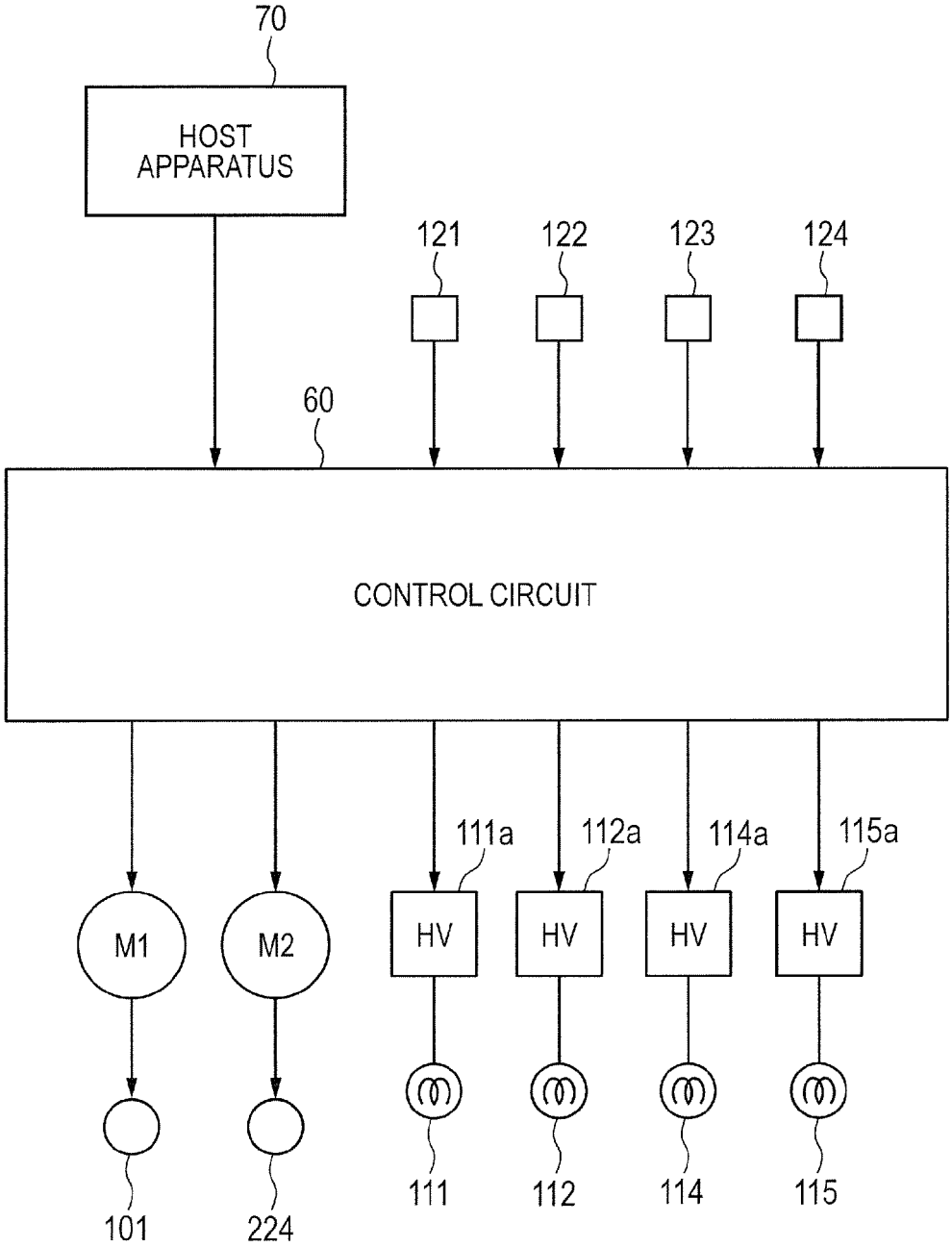
FIG. 8 is a block diagram of a control system of the fixing apparatus.

FIG. 2 is a partially cutaway schematic front view of a main part of the fixing apparatus 9 which functions as an image heating apparatus, and FIG. 3 is an enlarged cross-section view along the (3)-(3) line of FIG. 2. FIG. 4 is a right side view of an external heating belt assembly which functions as a belt unit (a belt conveyance device), FIG. 5 is an exploded perspective view of the assembly, and FIG. 6 is a perspective view of a pressurizing/pressurizing release mechanism of the assembly. FIG. 7 is a partially cutaway schematic plan view of the external heating belt assembly, and FIG. 8 is a block diagram of a control system of the fixing apparatus.

In the following description, a longitudinal direction (a width direction) of the fixing apparatus 9 or each member constituting this apparatus is a direction which is substantially parallel to an axial direction of a rotary member (a thrust direction) or to a direction perpendicular to a recording material conveying direction by the fixing apparatus. A short direction is a direction which is substantially parallel to the recording material conveying direction. Concerning the fixing apparatus 9, a front surface (a front side) is a surface (or the side) of the apparatus seen from a recording material inlet side, a rear surface (a rear side) is an opposite surface (or side: a recording material outlet side), and right/left is a right or left side of the apparatus seen from the front surface thereof.

An upside or downside is the upside or downside in a gravity direction. An upstream side and a downstream side are the upstream side and downstream side concerning the recording material conveying direction of the fixing apparatus or a moving direction of a fixing roller which functions as a heating rotary member.

The fixing apparatus 9 includes a fixing roller 101 which functions as the rotatable heating rotary member (a heating roller or an image heating member) which heats a non-fixed toner image K formed on the recording material (sheet) P, in a nip portion N. Moreover, the fixing apparatus 9 includes a pressurizing roller 102 which functions as a pressurizing rotary member (a nip forming member) to form the nip portion N for sandwiching and conveying the recording material between the fixing roller 101 and the pressurizing roller. Furthermore, the fixing apparatus 9 includes an external heating belt assembly 110 (hereinafter called the assembly 110) which functions as a belt unit (a belt conveying device) which heats the fixing roller 101 from the outside.

The fixing apparatus 9 has a function of heating and pressurizing the recording material P which bears the non-fixed toner image K, while holding and conveying the material in the nip portion N, to fix the toner image to the recording material. In the present embodiment, the recording materials having various large/small width sizes are introduced into the fixing apparatus 9 by center basis conveyance on the basis of the central position of each recording material in the width direction.

1) Fixing Roller 101

The fixing roller 101 includes right and left shaft portions 101*a* which are respectively arranged so as to be rotatably supported via bearing members 220 between a right main body side plate 202R and a left main body side plate 202L of a fixing apparatus frame body. The fixing roller 101 is formed by coating the outer peripheral surface of a hollow core metal (a metal pipe) having predetermined outer diameter and thickness with a toner mold release layer or successively with an elastic layer and the toner mold release layer. A halogen heater 111 is disposed as a heat generating member (an internal heating source) in the hollow core metal.

A drive gear G is secured to the right shaft portion 101*a* of the fixing roller 101. A drive force is transmitted to the gear G from a drive source M1 which is controlled by the control circuit (control means or a controller) 60. In consequence, the fixing roller 101 is rotated and driven at a predetermined speed in a clockwise direction of an arrow A in FIG. 3.

A power is supplied to the halogen heater 111 from a power source portion 111*a* which is controlled by the control circuit 60, through a power supply system (not-shown). In consequence, the heater 111 generates heat to heat the fixing roller 101 from the inside. A thermistor 121 which functions as temperature detecting means (a temperature sensor) is elastically brought into contact with the outer surface of the center of the fixing roller 101 in the longitudinal direction by an elastic support member (not shown). This thermistor 121 detects an outer surface temperature of the fixing roller 101, and the detected temperature information is fed back to the control circuit 60.

The control circuit 60 controls the power to be supplied from the power source portion 111*a* to the heater 111 so that the detected temperature (the information on the outer surface temperature) input from the thermistor 121 is maintained at a predetermined target temperature (a fixing temperature: information corresponding to a predetermined temperature). That is, when the heater 111 is turned ON/OFF, control (temperature adjustment) is executed so that the surface temperature of the fixing roller 101 becomes the predetermined target temperature.

2) Pressurizing Roller 102

The pressurizing roller 102 is disposed in parallel with the fixing roller 101 under the fixing roller 101, and right and left shaft portions 102*a* are respectively arranged so as to be rotatably supported via bearing members 221 between main body side plates 202R and 202L. The pressurizing roller 102 is formed by coating the outer peripheral surface of a hollow core metal (a metal pipe) having predetermined outer diameter and thickness with a toner mold release layer or successively with an elastic layer and the toner mold release layer. A halogen heater 112 is disposed as a heat generating member in the hollow core metal.

The right and left bearing members 221 can slidably move in an upward/downward direction with respect to the main body side plates 202R and 202L, respectively, and the members are pushed upwards and urged by compression reactive forces of pressurizing springs (urging members) 222 as pressurizing means. In consequence, the upper surface of the pressurizing roller 102 pushes and abuts on the lower surface of the fixing roller 101 with a predetermined pressing force, whereby between the fixing roller 101 and the pressurizing roller 102, the fixing nip portion N, which has a predetermined width in the recording material conveying direction, is formed. The pressurizing roller 102 follows the rotation of the fixing roller 101 to rotate in a counterclockwise direction B of an arrow.

A power is supplied to the halogen heater 112 from a power source portion 112*a* which is controlled by the control circuit 60, through a power supply system (not shown). In consequence, the heater 112 generates heat to heat the pressurizing roller 102 from the inside. A thermistor 122 which functions as temperature detecting means (a temperature sensor) is elastically brought into contact with the outer surface of the center of the pressurizing roller 102 in the longitudinal direction by an elastic support member (not shown). The thermistor 122 detects a surface temperature of the pressurizing roller 102, and the detected temperature information is fed back to the control circuit 60.

The control circuit 60 controls the power to be supplied from the power source portion 112*a* to the heater 112 so that the detected temperature input from the thermistor 122 is maintained at a predetermined target temperature. That is, when the heater 112 is turned ON/OFF, the control is executed so that the surface temperature of the pressurizing roller 102 becomes the predetermined target temperature.

In the present embodiment, when a main power of the image forming apparatus is supplied (a main switch is turned on), warm-up processing of the fixing apparatus is started. At this time, the fixing roller 101 and the pressurizing roller 102 are started up respectively at the respective target temperatures by the heaters in the warm-up processing, so as to obtain a standby state where image formation (fixing processing (image heating processing)) can start. Furthermore, at this time, the external heating belt is started up at a target temperature by a heater disposed in the belt. At this time, the external heating belt is separated from the fixing roller.

When a print command (an image formation start signal) is input, the control circuit 60 controls various devices of the image forming apparatus, and the toner image is formed on the recording material. Afterward, the external heating belt is made to abut on the fixing roller in accordance with a timing when the recording material enters the nip portion N. In consequence, the external heating belt heats the fixing roller from the outside, while driven to rotate by the fixing roller. Moreover, when the recording material P bearing the non-fixed toner image K is introduced into the fixing nip portion N from an image forming section side, the recording material P receives heat and pressure in the nip portion N to fix the non-fixed toner image K as the fixed image onto the recording material P.

When the image formation (the fixing process) ends, the external heating belt is separated from the fixing roller, and the external heating belt, the fixing roller and the pressurizing roller are brought into standby states, respectively. In the standby states, the respective heaters are controlled by the control circuit 60 so that the external heating belt, the fixing roller and the pressurizing roller maintain standby temperatures, respectively. In FIG. 3, a direction D is the conveying direction of the recording material P.

3) External Heating Belt Assembly 110

As shown in FIG. 3, the external heating belt assembly 110 which functions as the belt unit (the belt conveyance device) is external heating means which is disposed at an upper surface side position as, faces the pressurizing roller 102 via the fixing roller 101, and heats the fixing roller 101 from the outside.

The assembly 110 includes an external heating belt 105 (hereinafter called the belt 105) which functions as an external heating member for heating the fixing roller 101 from the outside, and the belt 105 is an endless belt having a flexibility. In the present embodiment, the belt 105 is formed by coating a flexible base material made of a metal such as stainless steel or nickel with a fluorine resin as a heat-resistant and low-slidability layer for preventing the sticking of toner.

The assembly 110 includes a plurality of support rollers arranged via a predetermined space, i.e., two support rollers of a first support roller 103 and a second support roller 104, and the belt 105 is looped around these support rollers with a predetermined tensile force. Moreover, the support rollers 103 and 104 are arranged in this order along a rotating direction of the fixing roller 101 as shown in FIG. 3. That is, the support roller 104 is positioned on the downstream side of the support roller 103 in the rotating direction of the fixing roller 101.

Each of the support rollers 103 and 104 is a hollow metal pipe having predetermined outer diameter and thickness, and halogen heaters 114 and 115 are arranged as heat generating members in the rollers, respectively. Powers are supplied to the halogen heaters 114 and 115 from power source portions 114*a* and 115*a* which are controlled by the control circuit 60 via power supply systems (not shown), respectively. In consequence, the heaters 114 and 115 generate heat to heat the support rollers 103 and 104 from the inside. In this way, the support rollers 103 and 104 are heated, and the belt 105 driven to rotate by the rotation of the fixing roller 101 is heated over the whole periphery of the belt by the support rollers 103 and 104.

In a contact area (a belt supporting portion of the roller 103) D1 between the support roller 103 and the belt 105 (FIG. 3), a thermistor 123 as temperature detecting means (a temperature sensor) is elastically brought into contact with the outer surface of the center of the belt 105 in the width direction by an elastic support member (not shown). The thermistor 123 detects the surface temperature of the belt 105, and the detected temperature information is fed back to the control circuit 60.

The control circuit 60 controls the power to be supplied from the power source portion 114*a* to the heater 114 so that the detected temperature input from the thermistor 123 is maintained at a predetermined target temperature. That is, when the heater 114 is turned ON/OFF, the control is executed so that the surface temperature of the belt 105 becomes the predetermined target temperature.

In a contact area (a belt supporting portion of the roller 104) D2 between the support roller 104 and the belt 105 (FIG. 3), a thermistor 124 as temperature detecting means (a temperature sensor) is elastically brought into contact with the outer surface of the center of the belt 105 in the width direction by an elastic support member (not shown). The thermistor 124 detects the surface temperature of the belt 105, and the detected temperature information is fed back to the control circuit 60.

The control circuit 60 controls the power to be supplied from the power source portion 115*a* to the heater 115 so that the detected temperature input from the thermistor 124 is maintained at a predetermined target temperature. That is, when the heater 115 is turned ON/OFF, the control is executed so that the surface temperature of the belt 105 becomes the predetermined target temperature.

In the present embodiment, the target temperature of the belt 105 (the target temperature of each of the support rollers 103 and 104) is set to be higher than the target temperature of the fixing roller 101. Therefore, even when the surface temperature of the fixing roller 101 lowers due to the contact of the roller with the recording material P in the nip portion N, the heat is supplied from the belt 105 to the fixing roller 101 with good response (the response of a temperature maintaining performance), and hence it is possible to appropriately maintain the temperature of the portion of the fixing roller 101 which enters into the nip portion N.

The support rollers 103 and 104 are provided with regulating members 211 for preventing the belt 105 from being inclined as much as a predetermined or more amount in the axial directions of the support rollers 103 and 104 (preventing the belt from dropping down from the support rollers), when the belt 105 is driven to rotate by the fixing roller 101. The regulating members 211 prevent predetermined or more relative displacement of the belt 105 with respect to the support rollers 103 and 104, and each of the regulating members is fixed to the vicinity of each end of each of the support rollers 103 and 104 in the axial direction thereof.

In the present embodiment, the regulating members 211 are arranged coaxially with the support rollers 103 and 104, respectively, and each of the regulating members is formed into a ring shape (a round flange or a round collar) having an outer diameter which is larger than that of each of the support rollers 103 and 104.

Furthermore, the assembly 110 includes two bearing plates (support members) 206 which rotatably support both ends of each of the support rollers 103 and 104 as shown in FIG. 5. Specifically, right and left shaft portions 103*a* of the support roller 103 are fitted into bearing round holes 206*a* made in the right and left bearing plates 206, respectively, and the shaft portions are arranged so as to be rotatably supported between the right bearing plate 206 and the left bearing plate 206.

On the other hand, right and left shaft portions 104*a* of the support roller 104 are fitted into bearing long holes 206*b* made in the right and left bearing plates 206 along a forward-backward direction, respectively, and the shaft portions are arranged so as to be rotatably supported between the right bearing plate 206 and the left bearing plate 206. The support roller 104 has such a degree of freedom as to slide and move in directions close to and away from the support roller 103 owing to the bearing long holes 206*b*. That is, the right and left bearing plates 206 rotatably support the support roller 104, and movably support in an arrow F direction which is the direction of a straight line connecting a rotation center Oa (FIG. 4) of the support roller 103 to a rotation center Ob of the support roller 104.

That is, in the plurality of support rollers 103 and 104, the support roller 104 positioned on the most downstream side is movably supported in a direction in which a distance between the center of the roller 104 and the center of the support roller 103, which is positioned on the most upstream side, linearly increases or decreases in accordance with a moving distance.

Moreover, the support roller 104 is constantly urged in the direction away from the support roller 103 by the compression reactive force of a pressurizing spring (an urging member) 109 as pressurizing means (urging means) which is fitted into the bearing long holes 206*b*. That is, the support roller 104 positioned on the most downstream side is urged in a direction in which a distance between the axis of the roller 104 and the axis of the support roller 103, which is positioned on the most upstream side, increases by the pressurizing spring 109. According to this constitution, the support roller 104 also functions as tension roller which imparts a tensile force to the belt 105. In the present embodiment, the same bearing plate 206 supports the plurality of support rollers 103 and 104.

As shown in FIGS. 4 and 5, the assembly 110 includes an intermediate frame 208 which functions as a coupling member to couple the two bearing plates 206. That is, the two bearing plates 206 are integrated by the intermediate frame 208. Specifically, in the two bearing plates 206, hole portions 206*c* are formed, respectively, and shafts 207 formed at both ends of the intermediate frame 208 in the longitudinal direction are inserted into hole portions 206*c* of the two bearing plates 206. Therefore, the two bearing plates 206 are independently rotatable around the shafts 207 at the both ends of the intermediate frame 208. That is, the intermediate frame 208 rotatably holds the support rollers 103 and 104 via the two bearing plates 206, on a lower surface side thereof.

As shown in FIGS. 3 and 4, in the intermediate frame 208, a swing shaft 209, which extends along a direction (a normal line direction in the upper surface of the intermediate frame 208) which is substantially perpendicular to a generating line (the axial direction) of the fixing roller 101, is formed on the surface of the frame on a side opposite to a side on which the fixing roller 101 is disposed. In other words, the swing shaft 209 extends along the direction which is substantially perpendicular to the axis lines of the two support rollers 103 and 104. Moreover, the swing shaft 209 extends along the direction which is substantially parallel to the normal line direction in the surface of the belt 105 which is positioned between the support roller 103 and the support roller 104 (the upside surface in FIG. 3, i.e., the linear surface on a side opposite to a side on which the belt comes in contact with the fixing roller 101).

Thus, in the present embodiment, the swing shaft 209 is disposed at a position where the shaft faces the fixing roller 101 via the belt 105, and the swing shaft 209 extends in the direction which is substantially parallel to the direction perpendicular to the axis line (the generating line) of the fixing roller 101 and which is away from the fixing roller 101. The swing shaft 209 is formed at the position which is substantially the center of the intermediate frame 208 in the longitudinal direction (the axial directions of the support rollers 103 and 104).

As shown in FIG. 4, the assembly 110 includes a cleaning roller 108 for cleaning the surface of the belt, the cleaning roller 108 comes in contact with the outer surface of a belt portion on the upside of the belt 105 looped around both the support rollers between the support roller 103 and the support roller 104. Shaft portions 108*a* at both ends of the cleaning roller 108 in the longitudinal direction are rotatably supported in hole portions 206*d* of the two bearing plates 206, respectively. Moreover, the cleaning roller 108 is pressed under a predetermined pressure onto the surface of the belt 105 by an urging member (not shown).

4) Holding Mechanism (Swing Mechanism) of Assembly 110

Next, there will be described a holding mechanism (a swing mechanism) 240 which swingably holds the assembly 110 (the belt 105) via the swing shaft 209 formed in the intermediate frame 208. In the present embodiment, the holding mechanism 240 includes a pressurizing frame 201 provided with a hole 201*a* by which the swing shaft 209 is held. The hole 201*a* is formed at a position which substantially becomes the center of the pressurizing frame 201 in the longitudinal direction.

When the shaft portion 209 of the intermediate frame 208 is inserted into the hole 201*a* of the pressurizing frame 201 from the downside and is retained in the pressurizing frame 201 by a C-ring (not shown) which is a fixture, the assembly 110 can be fixed to the pressurizing frame 201 via the shaft portion 209. In consequence, the shaft portion 209 is prevented from being relatively moved in the thrust direction with respect to the pressurizing frame 201. As shown in FIGS. 3 and 4, an intermediate roller 210 is rotatably disposed in the pressurizing frame 201.

In consequence, the intermediate frame 208 is rotatably (revolvably or swingably) held with respect to the pressurizing frame 201 in a predetermined rotation angle range (an intersecting angle range or a swing range) around the shaft portion 209, while keeping a predetermined space between the intermediate frame and the lower surface of the pressurizing frame 201 by the intermediate roller 210. Therefore, the belt 105 can swing in a direction which intersects a direction W (FIG. 5) parallel to the generating line of the fixing roller 101 (hereinafter, the direction W parallel to the generating line will be called the generating line direction W). In other words, the assembly 110 is held by the holding mechanism 240 so that a running direction C (FIG. 3) of the upper surface of the belt 105 intersects the direction which is perpendicular to the generating line direction W of the fixing roller 101.

In the present embodiment, the rotation angle range, in which the running direction C of the upper surface of the belt 105 can intersect the generating line direction W (the axial direction) of the fixing roller 101, is ±2° (a total of 4°) on the basis of the generating line direction W of the fixing roller 101. In other words, the rotation angle range in which the axial directions of the support rollers 103 and 104 can intersect the generating line direction of the fixing roller 101 is ±2° on the basis of the generating line direction W (the axial direction) of the fixing roller 101.

This is because the areas of the belt 105 which comes in contact with the support rollers 103 and 104 are fully brought into contact with the fixing roller 101 in the width direction, even when an intersecting angle of the belt 105 with respect to the fixing roller 101 becomes maximum (+2° and −2°). That is, all the areas of the belt 105 in the width direction are brought into pressure-contact with the fixing roller 101 by the support rollers 103 and 104 of the belt 105. Therefore, even when the intersecting angle of the belt 105 (the assembly 110) with respect to the fixing roller 101 becomes maximum, the area of the belt 105 which comes in contact with the fixing roller 101 substantially does not vary in the rotation angle range, and the fixing roller 101 can appropriately be heated by the belt 105. In consequence, it is possible to eliminate the possibility that the outer surface temperature of the fixing roller 101 fluctuates, and it is possible to suppress the generation of a fixing defect.

5) Contact/Separating Mechanism of Assembly 110

The belt assembly 110 relatively moves with respect to the fixing roller by a contact/separating mechanism, so that the belt 105 comes in contact with the fixing roller 101 and comes away from the fixing roller. This mechanism separates the belt 105 from the fixing roller 101 in a standby state, and brings the belt 105 into contact with the fixing roller 101 when the image is formed (during the fixing processing). Hereinafter, the contact/separating mechanism will specifically be described.

As shown in FIGS. 2, 5 and 6, the pressurizing frame 201 is supported so as to be rotatable in the upward-downward direction around stay shafts 203 of which front sides is fixed between the right main body side plate 202R and the left main body side plate 202L. Pressurizing springs 204, which function as urging members, are compressed and arranged between an immobile spring bracket 223 on a fixing apparatus frame body side above the pressurizing frame 201 and the upper surface of the pressurizing frame. In consequence, the pressurizing frame 201 is urged around the turning shafts 203 downwardly to the fixing roller 101.

Under the pressurizing frame 201 on a rear side thereof, a cam shaft 224 is rotatably supported between the main body side plate 202R and the main body side plate 202L. A pair of eccentric cams 225 is fixed to the cam shaft 224 on the right and left sides thereof. The pair of eccentric cams 225 has the same shape and the same phase. The cam shaft 224 is controlled, so as to intermittently rotate as much as about 180° to a first rotation angle state (a two-dots chain line of FIG. 3) where large ridge portions of the eccentric cams 225 are directed upwards and a second rotation angle state (a solid line of FIG. 3) where small ridge portions are directed upwards, by a drive source M2 which is controlled by the control circuit 60.

When the cam shaft 224 is set to the first rotation angle state, the pressurizing frame 201 is raised and turned around the shafts 203 against pressurizing forces of the pressurizing springs 204 by the large ridge portions of the eccentric cams 225, and is held at a raised position (the two-dots chain line of FIG. 3). In this state, the assembly 110 comes away from the fixing roller 101, and the belt 105 looped around the support rollers 103 and 104 is separated from the fixing roller 101 (a separated state of the assembly 110).

In the standby state of the image forming apparatus 50, the control circuit 60 turns off the drive source M1 to stop the driving of the fixing roller 101. Moreover, the control circuit 60 turns off the energization of the heaters 111 and 112. Furthermore, the control circuit 60 sets the cam shaft 224 to the first rotation angle state to bring the assembly 110 into the separated state.

The control circuit 60 turns on the drive source M1 to drive and rotate the fixing roller 101 on the basis of an input of an image forming signal. Accordingly, the pressurizing roller 102 is driven to rotate. Moreover, the control circuit 60 turns on the energization of the heaters 111 and 112, and raises the surface temperatures of the fixing roller 101 and the pressurizing roller 102 to predetermined target temperatures, respectively. In accordance with a timing when a preparing operation for the image formation ends and the fixing processing starts, the control circuit 60 changes the cam shaft 224 from the first rotation angle state to the second rotation angle state by the drive source M2. Thereby, as the small ridge portions of the eccentric cams 225 turn upwards, the pressurizing frame 201 is turned so as to lower around the shafts 203 by the pressurizing forces of the pressurizing springs 204.

A lower portion of the belt 105 looped around the support rollers 103 and 104 comes in contact with the upper surface of the fixing roller 101, and the support rollers 103 and 104 come in pressure-contact with the fixing roller 101 via the belt 105. Then, the small ridge portions of the eccentric cams 225 finally turn to direct upwards, whereby the eccentric cams 225 do not come in contact with the pressurizing frame 201.

In this state, the support rollers 103 and 104 have an abutment state where the rollers are uniformly pressed onto the upper surface of the fixing roller 101 via the belt 105 with a predetermined pressure due to the pressurizing forces of the pressurizing springs 204 (an abutment state of the assembly 110).

In the abutment state of the assembly 110, the lower portion of the belt 105 looped around the support rollers 103 and 104 comes in contact with the fixing roller 101 to form a large heating nip Ne (FIG. 3) between the portion and the fixing roller 101. In this state, the belt 105 is driven to rotate in the counterclockwise direction C indicated by an arrow according to the rotation of the fixing roller 101, owing to a frictional force between the belt and the fixing roller 101. The support rollers 103 and 104 and the cleaning roller 108 are driven to rotate according to the rotation of the belt 105.

In the present embodiment, since the large heating nip Ne can be formed in the peripheral direction of the fixing roller 101 by use of the belt 105, it is possible to cope with the increase of the fixing speed for a recording material such as a thick paper having a large heat capacity.

6) Principle to Suppress Inclination of External Heating Belt

In the present embodiment, the external heating belt assembly 110 autonomously intersects the generating line of the fixing roller 101, whereby the inclined movement of the belt 105 (the relative movement of the belt 105 with respect to the support rollers 103 and 104 in the axial directions of the support rollers 103 and 104) is corrected. The external heating belt assembly 110 and the holding mechanism 240 thereof in the present embodiment have a so-called self-centering function of the external heating belt 105. Hereinafter, description will be made in more detail. Specifically, the position where the swing shaft 209 is disposed is offset on the upstream side in the rotating direction of the fixing roller 101.

Figure 9:
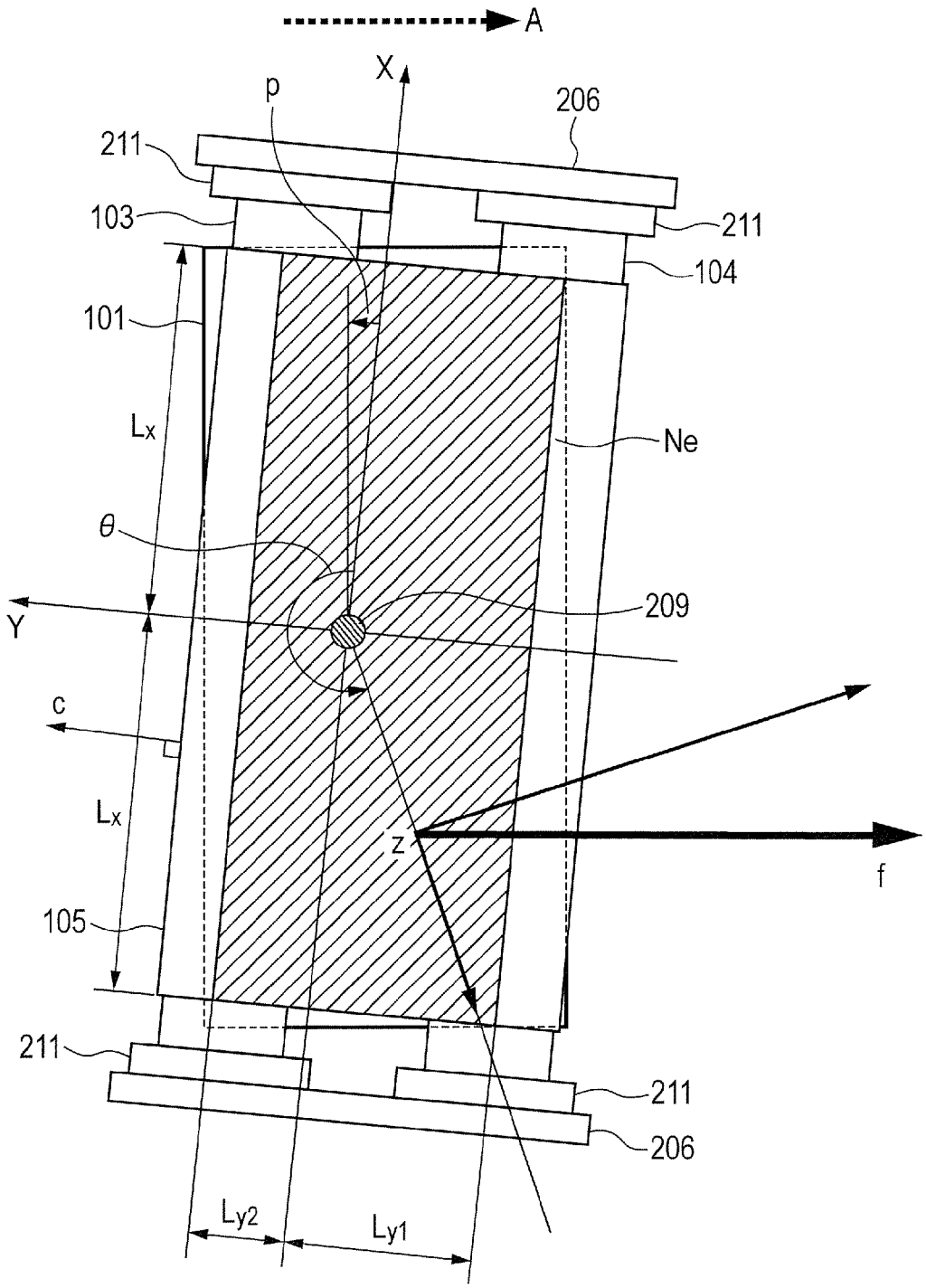
FIG. 9 illustrates a relation between forces which act on an external heating belt, when an intermediate frame tilts to a fixing roller.

There will be described a force to be received from the fixing roller 101 by the belt 105 (the assembly 110), when the belt 105 intersects the fixing roller 101. FIG. 9 is a schematic view showing that the intermediate frame 208 tilts at a certain angle to the fixing roller 101 in a state where the belt 105 comes in contact with the fixing roller 101.

The belt 105 is driven to rotate according to the rotation of the fixing roller 101 by the frictional force received from the fixing roller 101. That is, the belt 105 receives the frictional force in the same direction as the rotating direction of the fixing roller 101 in the surface Ne where the belt comes in contact with the fixing roller 101, and is driven to rotate.

The intermediate frame 208 which holds the support rollers 103 and 104 can rotate (can swing) around the swing shaft 209 which extends in the normal line direction in the surface Ne where the belt 105 comes in contact with the fixing roller 101.

The frictional force which acts on a mass point Z of the belt 105 in the contact surface Ne allows the intermediate frame 208 (the assembly 110 and the belt 105) to rotate around the shaft 209, but this rotational moment is represented by the following equation (1) (see FIG. 9).

$$m=-rf\cos(\theta-\rho) \quad \text{Equation (1)}$$

Here, as shown in FIG. 9, the contact surface Ne of the belt 105 means an area obtained by developing the area where the belt 105 comes in contact with the fixing roller 101 in an X-Y plane. The X-axis means a direction in which the swing shaft 209 is an original point and which is substantially parallel to the axial direction (the width direction of the belt 105) of the support roller 103 (the support roller 104) (in FIG. 9, the upside above the original point is positive). The Y-axis means a direction in which the swing shaft 209 is an original point and which is perpendicular to the X-axis and substantially parallel to running direction C of the upper surface of the belt 105. (r, θ) is a coordinate of the mass point when the position of the shaft 209 projected on the contact surface Ne is the original point, f is a frictional force received by the mass point, and ρ is an intersecting angle (a tilt angle or a swing angle) between the fixing roller 101 and the intermediate frame 208. The moment has a positive value, when a direction of the moment is the counterclockwise direction.

A sum M1 of moments which act on an X-axis negative area and a sum M2 of moments which act on an X-axis positive area are obtained by integrating the above equation in each area, and are represented by the following equations (2) and (3).

$$M1=f/2\times LxLy1\hat{}2\times\sin\rho \quad \text{Equation (2)}$$

$$M2=-f/2\times LxLy2\hat{}2\times\sin\rho \quad \text{Equation (3)}$$

Here, Lx is a distance to an end of the belt in the width direction from the position where the shaft 209 is projected, on the contact surface Ne between the fixing roller 101 and the belt 105. Ly1 is a distance from the position of the shaft 209 to an end of the contact surface Ne on the downstream side of the belt 105 in a moving direction of the belt. Ly2 is a distance from the position of the shaft 209 to an end of the contact surface Ne on the upstream side of the belt 105 in the moving direction of the belt.

As seen from the equation, the moment M1 which acts on the X-axis negative area becomes constantly positive, and the force acts on the belt 105 (the assembly 110) in a direction in which the intersecting angle ρ is made smaller. The moment M2 which acts on the X-axis positive area becomes constantly negative, and the force acts on the belt 105 (the assembly 110) in a direction in which the intersecting angle ρ is made larger. These moments are proportional to the squares of the distances Ly1 and Ly2, and hence a moment sum (M1+M2) changes in accordance with the position of the shaft 209.

Figure 10:
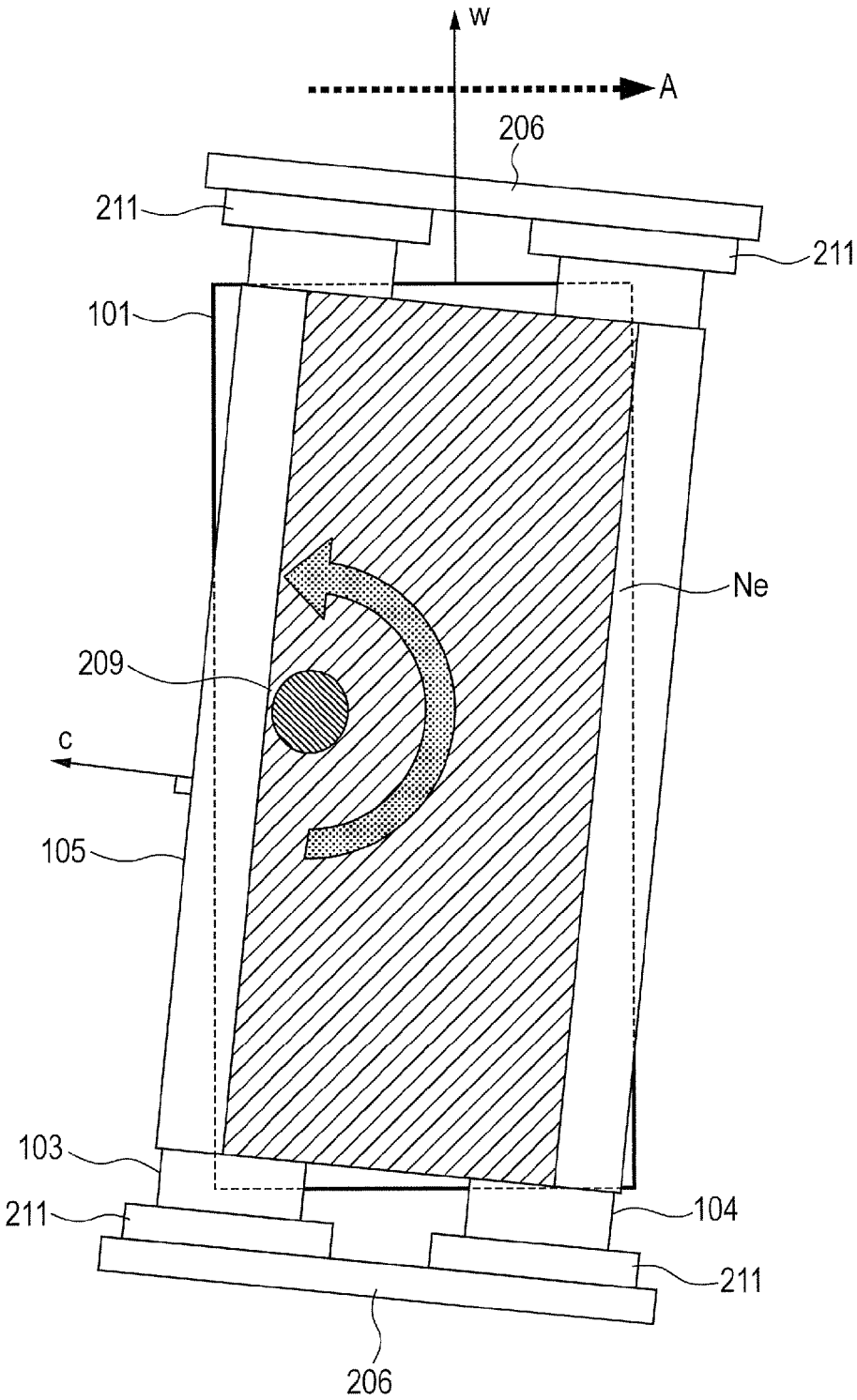
FIG. 10 is an explanatory view of a position where a rotary shaft is disposed.

FIG. 10 is a top plan view of the external heating belt 105 seen from a side which is away from the fixing roller 101. In the present embodiment, when the position of the swing shaft 209 is projected onto the contact surface Ne between the fixing roller 101 and the belt 105, the shaft is offset-disposed on the upstream side from the center of the contact surface Ne in the rotating direction A of the fixing roller 101 in the contact surface Ne. The swing shaft 209 is disposed in an area which overlaps with the support roller 103.

In this case, concerning the contact surface Ne, a contact area on the downstream side from the shaft 209 in the moving direction of the belt 105 becomes larger than a contact area on the upstream side from the shaft 209 in the moving direction of the belt 105. Therefore, the sum of the moments becomes positive. At this time, when the intermediate frame 208 turns, the intersecting angle ρ becomes small, and the fixing roller 101 becomes substantially parallel to the support rollers 103 and 104. An absolute value of the moment is proportional to sinρ, and hence the moment does not work as the intersecting angle ρ becomes smaller. Moreover, the intermediate frame 208 becomes stable in a posture in which the inclined movement of the belt 105 does not easily occur. When the shaft 209 is offset-disposed on the upstream side in the rotating direction of the fixing roller 101 from the center position of the contact surface Ne, the belt 105 can autonomously be set to the state where the inclined movement of the belt does not easily occur.

Thus, the intermediate frame 208 (the assembly 110 and the belt 105) is configured to be rotatable (revolvable and swingable) around the shaft 209 with respect to the pressurizing frame 201 (the fixing roller 101), the inclined movement of the belt 105 can be corrected. That is, it is possible to enhance the running stability of the belt 105. In the present embodiment, the running stability of the belt 105 can be enhanced without impairing the function of heating the fixing roller 101 from the outside by the belt 105.

7) Inclination of Belt 105 due to Fluctuations of Urging Forces of Pressurizing Springs 204

Figure 11:
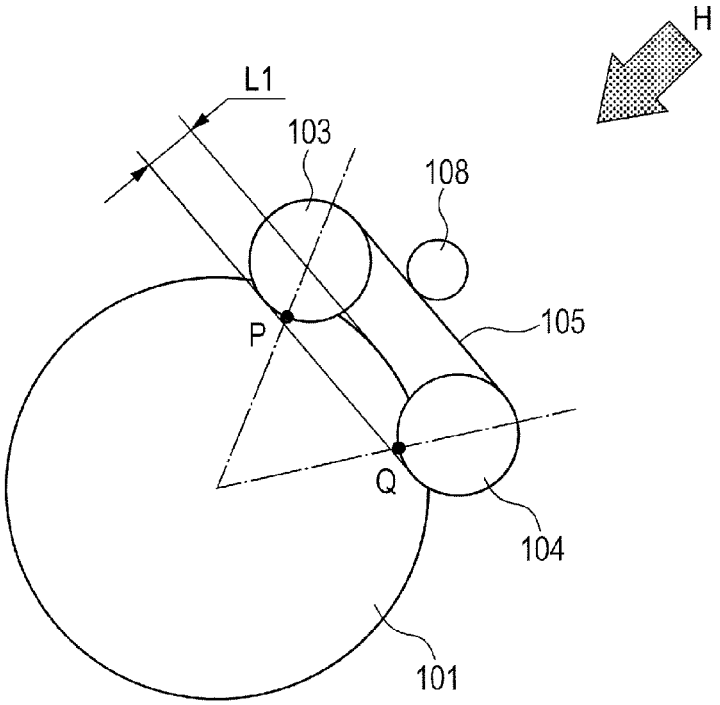
FIG. 11 is a schematic view illustrating a pressurizing force and a positional relation between support rollers and the fixing roller.

FIG. 11 is a schematic view illustrating that the belt assembly 110, i.e., the support rollers 103 and 104 come in pressure-contact with the fixing roller 101 via the belt 105 by the urging forces of the pressurizing springs 204 (FIGS. 2, 3 and 4). First, the belt 105 is held with a predetermined tensile force in a state where the support rollers 103 and 104 in the belt 105 are supported by the pressurizing springs 109 (FIG. 5) so that distances between the central axes of the respective support rollers become about the same.

In the state, the cams 225 are turned. Thereby the support rollers 103 and 104 are urged onto the outer peripheral surface of the fixing roller 101 by the urging forces generated by the pressurizing springs 204 until the rollers bite into the fixing roller 101 as much as a penetration amount L1. In FIG. 11, this state is exaggerated and illustrated.

The pressurizing springs 204 are arranged on the right and left sides of the upper surface of the pressurizing frame 201 (at both ends in the longitudinal direction) to urge the support rollers 103 and 104 to the fixing roller 101 at two positions, and hence the penetration amount L1 varies in the roller longitudinal direction owing to fluctuations of the urging forces of the right and left pressurizing springs 204. At this time, when the penetration amount L1 is large, a conveyance speed of the belt 105 which is driven by the fixing roller 101 becomes high, and conversely, when the penetration amount L1 is small, the conveyance speed of the belt 105 relatively becomes low as compared with the case where the amount is large.

When there is a difference in conveyance speed of the belt 105 configured to be seamless, a force to incline from a high speed side to a low speed side acts on the belt 105 itself. For example, when the pressurizing force (the urging force) on the left side in the longitudinal direction is large and the pressurizing force on the right side in the longitudinal direction is small as shown in FIG. 12 which is a view seen from an arrow of FIG. 11 (the view seen from a direction of arrow H), a force to incline and move the belt 105 in a direction of arrow D acts.

On the other hand, when the penetration amount L1 of the support rollers 103 and 104 is large, a belt length from point P to point Q shown in FIG. 11 becomes longer than when the penetration amount L1 is small. Therefore, when the penetration amount L1 is large, the force acts in a direction in which the distance between the central axis of the support roller 103 and the central axis of the support roller 104 shortens, as compared with the case where the amount is small.

Figure 12:
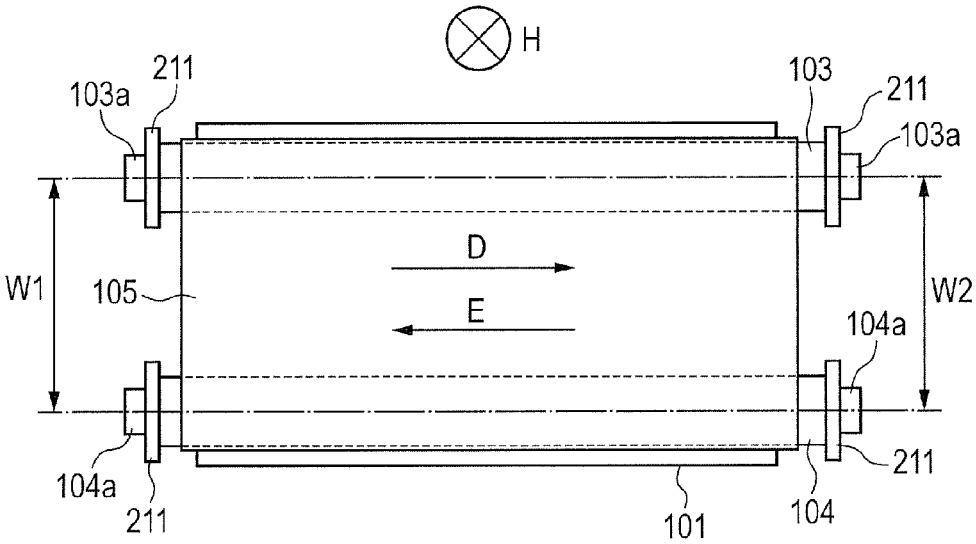
FIG. 12 is a schematic view seen from an arrow direction in FIG. 11.

That is, when the pressurizing force (the urging force) on the left side in the longitudinal direction is large and the pressurizing force on the right side in the longitudinal direction is small as shown in FIG. 12 which is the view seen from the arrow of FIG. 11, a distance W1 between the axes becomes shorter than a distance W2 between the axes. Therefore, in the support roller 104, a force in such a direction as to intersect the axis line of the fixing roller 101 (twist) is generated, and this twist generates a force to incline the belt 105 from a side on which the distance between the axes is large to a side on which the distance is small. This force cancels the inclining force due to the difference in conveyance speed, and produces an effect of decreasing the inclining force of the belt 105. That is, the intersecting angle is generated between the conveying direction of the belt 105 and the rotating direction of the fixing roller 101, and a force to thrust and move in a direction of arrow E acts on the belt 105. In the present embodiment, even when there is a difference in the urging force (the pressurizing force) between the two pressurizing springs 204, it is possible to autonomously perform the self-centering function of the belt 105, because the distance between the axis of the support roller 103 and the axis of the support roller 104 is configured to vary.

In the present embodiment, in the support rollers 103 and 104, the support roller 104 positioned on the downstream side in the rotating direction of the fixing roller in the contact surface Ne is supported with respect to the intermediate frame 208 which functions as the holding unit (the holding mechanism) as shown in FIGS. 4 and 5. That is, the support roller 104 is supported to be movable in a direction in which the distance between the center of the roller and the center of the support roller 103 linearly increases or decreases.

Consequently, when there is a difference in the urging force of the external heating belt assembly 110 to the fixing roller 101 in the longitudinal direction (when there is a difference in the urging force between the two pressurizing springs 204), the support roller 104 (at least one end side thereof in the axial direction) moves as much as a predetermined distance in the F direction (FIG. 4). In consequence, the force for thrust-moving the belt 105 due to the conveyance speed difference, and the urging force difference in the longitudinal direction thereof are used, and thus, the distance between the axis of the support roller 103 and the axis of the support roller 104 is corrected. Therefore, a force to move the belt 105 toward a side opposite to a side on which the belt 105 is inclined can be generated to cancel the inclination.

In consequence, the fluctuations of the urging forces of the two pressurizing springs 204 are absorbed, and stable belt conveyance is performed. That is, even when the urging force to bring the belt 105 into pressure-contact with the fixing roller 101 fluctuates, by the operation of the belt itself, the distance between the axis of the support roller 103 and the axis of the support roller 104 can be varied between one end and the other end of the support roller 103 (104) in the axial direction. Consequently, the belt 105 can be made to follow the running direction of the fixing roller 101 so that the running direction of the belt 105 matches the rotating direction of the fixing roller 101. When the inclining force of the belt 105 is suppressed, the life of the belt 105 can be lengthened.

In the above-mentioned embodiment, the fixing apparatus has been described as an example of the image heating apparatus, but the present invention is not limited to this example. For example, the present invention can effectively be used as a gloss increasing apparatus (an image reforming apparatus) which heats an image fixed to a recording material to increase the gloss of the image.

Moreover, examples of the image heating member can include not only the roller member but also an endless belt member to be rotated and driven.

In addition, the number of the support rollers around which the belt 105 is looped is not limited to two, and the belt 105 may be looped around three or more support rollers. Also in this case, the distance between the axes of two support rollers which come in pressure-contact with the fixing roller via the belt among the plurality of support rollers is configured to be variable (between one end side and the other end side in the axial direction).

Moreover, heating means for heating the belt 105 is not limited to the halogen heater, and there may be employed a system in which the belt 105 is electromagnetically inductively heated by an excitation coil. In this case, the belt includes a metal layer to be electromagnetically inductively heated.

Furthermore, the pressurizing member 102 is not limited to a roller member. There may be used an endless belt member to be rotated and driven. In addition, the member may have a configuration of a non-rotary member (a pressurizing pad or the like) having a small friction coefficient of the surface (the surface of the member which abuts on the fixing roller or the recording material).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-187163, filed Aug. 30, 2011, which is hereby incorporated by reference herein in its entirety.

What is claimed is:

1. An image heating apparatus comprising:

a heating rotary member configured to heat a toner image on a recording material;

a belt unit including an endless belt configured to heat an outer surface of the heating rotary member by coming in contact with the outer surface of the heating rotary member, and a first support roller and a second support roller configured to rotatably support an inner surface of the endless belt and make the endless belt press against the heating rotary member; and a holding unit configured to hold the belt unit so as to permit a swinging of the belt unit in a direction in which an axis line of the first support roller at the time when the endless belt and the heating rotary member are in contact with each other intersects a generating line of the heating rotary member, wherein the belt unit includes a support portion which slidably supports the second support roller so that a distance between a center of the first support roller and a center of the second support roller is variable.

2. The image heating apparatus according to claim 1, wherein the belt unit includes an urging portion which urges the second support roller in a direction in which the distance between the centers increases.

3. The image heating apparatus according to claim 1, wherein the holding unit is configured to permit the swinging of the belt unit while maintaining a state where the first support roller and the second support roller come in pressure-contact with the heating rotary member via the endless belt.

4. The image heating apparatus according to claim 1, further comprising two urging portions which are arranged on both end sides of the endless belt in a width direction of the endless belt and urge the holding unit so that the endless belt comes in pressure-contact with the heating rotary member.

5. The image heating apparatus according to claim 4, wherein the heating rotary member includes an elastic layer, and the two urging portions urge so that an area of the endless belt which is supported by the first support roller and the second support roller bites into the elastic layer.

6. The image heating apparatus according to claim 1, further comprising a rotary member which forms a nip portion to nip and convey the recording material between the rotary member and the heating rotary member.

7. The image heating apparatus according to claim 1, wherein the second support roller is disposed on a downstream side of the first support roller in a rotating direction of the heating rotary member, and the belt unit includes a regulating portion which is disposed coaxially with the second support roller and abuts on an end of the endless belt in a width direction of the endless belt to regulate the movement of the endless belt in the width direction.

8. An image heating apparatus comprising:

a heating rotary member which heats a toner image on a recording material;

a belt unit including an endless belt which comes in contact with and heats an outer surface of the heating rotary member, and two support rollers which rotatably support an inner surface of the endless belt and press the endless belt onto the heating rotary member so that the endless belt comes in contact with the heating rotary member;

a swing shaft which is disposed on a side opposite to the heating rotary member with respect to the endless belt and is substantially parallel to a normal line direction of a surface of the endless belt which is positioned between the two support rollers; and a holding unit which holds the belt unit so as to permit a swinging of the belt unit around the swing shaft, wherein the belt unit includes a support portion which slidably supports one of the two support rollers so that a distance between centers of the two support rollers is variable.

9. The image heating apparatus according to claim 8, wherein the one support roller of the two support rollers is disposed on a downstream side of the other support roller of the two support rollers in a rotating direction of the heating rotary member.

10. The image heating apparatus according to claim 8, wherein the belt unit includes an urging portion which urges the one support roller in a direction in which the distance between the centers increases.

11. The image heating apparatus according to claim 8, wherein the holding unit swingably holds the belt unit while maintaining a state where the support rollers come in pressure-contact with the heating rotary member via the endless belt.

12. The image heating apparatus according to claim 8, wherein the swing shaft is offset-disposed on an upstream side of a center position between the support rollers in a rotating direction of the heating rotary member.

13. The image heating apparatus according to claim 12, wherein the other support roller of the two support rollers is disposed on an upstream side of the one support roller of the two support rollers in the rotating direction, and wherein the swing shaft is disposed to face the other support roller of the two support rollers.

14. The image heating apparatus according to claim 8, wherein the swing shaft is disposed to face a position which becomes substantially center of the one support roller in an axial direction of the one support roller.

15. The image heating apparatus according to claim 8, wherein the surface of the endless belt is a substantially flat surface.

16. The image heating apparatus according to claim 8, further comprising two urging portions which are arranged on both end sides of the endless belt in a width direction of the endless belt and urge the holding unit so that the endless belt comes in pressure-contact with the heating rotary member.

17. The image heating apparatus according to claim 16, wherein the heating rotary member includes an elastic layer, and the urging portions urge so that an area of the endless belt which is supported by the support rollers bites into the elastic layer.

18. The image heating apparatus according to claim 8, further comprising a rotary member which forms a nip portion to nip and convey the recording material between the rotary member and the heating rotary member.

19. The image heating apparatus according to claim 8, wherein the one support roller of the two support rollers is disposed on a downstream side of the other support roller of the two support rollers in a rotating direction of the heating rotary member, and the belt unit includes a regulating portion which is disposed coaxially with the one support roller and abuts on an end of the endless belt in a width direction of the endless belt to regulate the movement of the endless belt in the width direction.

20. An image heating apparatus comprising:

a heating rotary member configured to heat a toner image on a recording material;

a belt unit including an endless belt configured to heat an outer surface of the heating rotary member by coming in contact with the outer surface of the heating rotary member, and a first support roller and a second support roller configured to rotatably support an inner surface of the endless belt and make the endless belt press against the heating rotary member; and a holding unit configured to hold the belt unit so as to permit a tilting of the belt unit in a direction in which an axial direction of the first support roller at the time when the endless belt and the heating rotary member are in contact with each other intersects a generatrix direction of the heating rotary member, wherein the belt unit includes a support portion which slidably supports the second support roller so that a distance between a center of the first support roller and a center of the second support roller is variable.

21. The image heating apparatus according to claim 20, wherein the belt unit includes an urging portion which urges the second support roller in a direction in which the distance between the centers increases.

22. The image heating apparatus according to claim 20, wherein the holding unit is configured to permit the tilting of the belt unit while maintaining a state where the first support roller and the second support roller come in pressure-contact with the heating rotary member via the endless belt.

23. The image heating apparatus according to claim 20, further comprising two urging portions which are arranged on both end sides of the endless belt in a width direction of the endless belt and urge the holding unit so that the endless belt comes in pressure-contact with the heating rotary member.

24. The image heating apparatus according to claim 23, wherein the heating rotary member includes an elastic layer, and the two urging portions urge so that an area of the endless belt which is supported by the first support roller and the second support roller bites into the elastic layer.

25. The image heating apparatus according to claim 20, further comprising a rotary member which forms a nip portion to nip and convey the recording material between the rotary member and the heating rotary member.

26. The image heating apparatus according to claim 20, wherein the second support roller is disposed on a downstream side of the first support roller in a rotating direction of the heating rotary member, and the belt unit includes a regulating portion which is disposed coaxially with the second support roller and abuts on an end of the endless belt in a width direction of the endless belt to regulate the movement of the endless belt in the width direction.

27. An image heating apparatus comprising:

a heating rotary member which heats a toner image on a recording material;

a belt unit including an endless belt which comes in contact with and heats an outer surface of the heating rotary member, and two support rollers which rotatably support an inner surface of the endless belt and make the endless belt press against the heating rotary member;

a tilting shaft which is disposed on a side opposite to the heating rotary member with respect to the endless belt and is substantially parallel to a normal line direction of a surface of the endless belt which is positioned between the two support rollers; and a holding unit which holds the belt unit so as to permit a tilting of the belt unit around the tilting shaft, wherein the belt unit includes a support portion which slidably supports one of the two support rollers so that a distance between centers of the two support rollers is variable.

28. The image heating apparatus according to claim 27, wherein the one support roller of the two support rollers is disposed on a downstream side of the other support roller of the two support rollers in a rotating direction of the heating rotary member.

29. The image heating apparatus according to claim 27, wherein the belt unit includes an urging portion which urges the one support roller in a direction in which the distance between the centers increases.

30. The image heating apparatus according to claim 27, wherein the holding unit swingably holds the belt unit while maintaining a state where the support rollers come in pressure-contact with the heating rotary member via the endless belt.

31. The image heating apparatus according to claim 27, wherein the tilting shaft is offset-disposed on an upstream side of a center position between the support rollers in a rotating direction of the heating rotary member.

32. The image heating apparatus according to claim 31, wherein the other support roller of the two support rollers is disposed on an upstream side of the one support roller of the two support rollers in the rotating direction, and wherein the swing shaft is disposed to face the other support roller of the two support rollers.

33. The image heating apparatus according to claim 27, wherein the swing shaft is disposed to face a position which becomes substantially center of the one support roller in an axial direction of the one support roller.

34. The image heating apparatus according to claim 27, wherein the surface of the endless belt is a substantially flat surface.

35. The image heating apparatus according to claim 27, further comprising two urging portions which are arranged on both end sides of the endless belt in a width direction of the endless belt and urge the holding unit so that the endless belt comes in pressure-contact with the heating rotary member.

36. The image heating apparatus according to claim 35, wherein the heating rotary member includes an elastic layer, and the urging portions urge so that an area of the endless belt which is supported by the support rollers bites into the elastic layer.

37. The image heating apparatus according to claim 27, further comprising a rotary member which forms a nip portion to nip and convey the recording material between the rotary member and the heating rotary member.

38. The image heating apparatus according to claim 27, wherein the one support roller of the two support rollers is disposed on a downstream side of the other support roller of the two support rollers in a rotating direction of the heating rotary member, and the belt unit includes a regulating portion which is disposed coaxially with the one support roller and abuts on an end of the endless belt in a width direction of the endless belt to regulate the movement of the endless belt in the width direction.

* * * * *